US010305202B2

(12) United States Patent
Maesoba et al.

(10) Patent No.: US 10,305,202 B2
(45) Date of Patent: May 28, 2019

(54) SHIELD TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Kazuhiro Yoshida, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/896,342

(22) Filed: Feb. 14, 2018

(65) Prior Publication Data

US 2018/0261933 A1 Sep. 13, 2018

(51) Int. Cl.

| | |
|---|---|
| ***H01R 9/03*** | (2006.01) |
| ***H01R 13/422*** | (2006.01) |
| ***H01R 13/6581*** | (2011.01) |
| *H01R 13/642* | (2006.01) |

(52) U.S. Cl.

CPC ..... *H01R 9/038* (2013.01); *H01R 13/422* (2013.01); *H01R 13/6581* (2013.01); *H01R 13/642* (2013.01)

(58) Field of Classification Search

CPC ..... H01R 9/038; H01R 9/032

See application file for complete search history.

(56) References Cited

U.S. PATENT DOCUMENTS 8,708,718 B2 * 4/2014 Li ..... H01R 9/034 439/108

FOREIGN PATENT DOCUMENTS

JP 2012-129103 7/2012

* cited by examiner

*Primary Examiner* — Ross N Gushi

(74) *Attorney, Agent, or Firm* — Gerald E. Hespos; Michael J. Porco; Matthew T. Hespos

(57) ABSTRACT

A shield terminal (12) includes inner conductors (14) having tabs (16) projecting forward from bodies (15), a dielectric (21) formed with conductor accommodation chambers (36) inside and configured to hold the inner conductors (14) with the bodies (15) accommodated in the conductor accommodation chambers (36), an outer conductor (37) for surrounding the dielectric (21) and the tabs (16), and walls (23, 31 and 32) constituting the conductor accommodation chambers (36) and formed with air chambers (43 to 50). Focusing on the fact that air has a lower dielectric constant than synthetic resin, the air chambers (43 to 50) are formed in the walls (23, 31 and 32) constituting the conductor accommodation chambers (36). This enables an impedance to be enhanced even if the dielectric (21) is made of a material having high rigidity.

11 Claims, 11 Drawing Sheets

SHIELD TERMINAL

BACKGROUND

Field of the Invention

The present invention relates to a shield terminal.

Related Art

Japanese Unexamined Patent Publication No. 2012-129103 discloses a shield terminal formed such that an inner conductor terminal is accommodated in a dielectric and the dielectric is surrounded by an outer conductor terminal. In the case of using a shield terminal of this type in a high-speed communication circuit, impedance matching is preferable to enhance the reliability of communication performance.

If an impedance of a shield terminal is low, it is thought to use a material having a low dielectric constant, e.g. polypropylene as a material of the dielectric as a means for enhancing the impedance. However, since polypropylene has low rigidity, it cannot be said to be desirable as a material having a function of stably holding the inner conductor terminal.

The invention was completed on the basis of the above situation and aims to enhance an impedance without reducing the rigidity of a dielectric.

SUMMARY

The invention relates to a shield terminal with an inner conductor having a tab projecting forward from a body. A dielectric is formed with a conductor accommodation chamber inside and is configured to hold the inner conductor with the body accommodated in the conductor accommodation chamber. An outer conductor surrounds the dielectric and the tab, and a wall at least partly constituting the conductor accommodation chamber is formed with an air chamber.

The dielectric may be configured by uniting a first component formed with at least one groove forming at least part of the conductor accommodation chamber and a second component for holding the inner conductor mounted in the groove to position the inner conductor between the first component and the second component.

The components of the dielectric may be kept together by locking a side surface of the first component and a lock formed on a side surface of the second component.

The air chamber may be formed in at least one wall selected from a bottom wall of the first component and an upper wall of the second component.

The bottom wall and the upper wall are areas not formed with the lock. Thus, a degree of freedom in design is high in setting the formation position of the air chamber.

The dielectric may be configured by uniting a first component formed with at least one groove forming at least part of the conductor accommodation chamber by erecting at least one separation wall to rise from a base wall and a second component including a ceiling wall for at least partly covering the groove.

The first component may be made of a material having a lower dielectric constant than the second component. Additionally, the second component may be made of a material having higher mechanical strength than the first component.

Accordingly, the first component is made of the material having lower mechanical strength than the second component. However, the strength is increased as a whole by the separation wall. Further, the first component has a large volume and a low dielectric constant. Thus, impedance can be enhanced.

The second component may be formed with at least one side plate that may be locked to an outer surface of a side wall of the first component.

The air chamber may be formed in the side plate. Since the second component is made of the material having higher mechanical strength than the first component, the strength of the side plate portion is maintained even if the air chamber is formed in the side plate portion.

The shield terminal may be a connecting member forming part of a wiring harness for Ethernet.

Focusing on the fact that air has a lower dielectric constant than synthetic resin, the air chamber was formed in the wall portion constituting the conductor accommodation chamber. This enables an impedance to be enhanced even if the dielectric is made of a material having high rigidity.

These and other features and advantages of the invention will become more apparent upon reading of the following detailed description and accompanying drawings. It should be understood that even though embodiments are described separately, single features thereof may be combined to additional embodiments.

DETAILED DESCRIPTION

Figure 1:
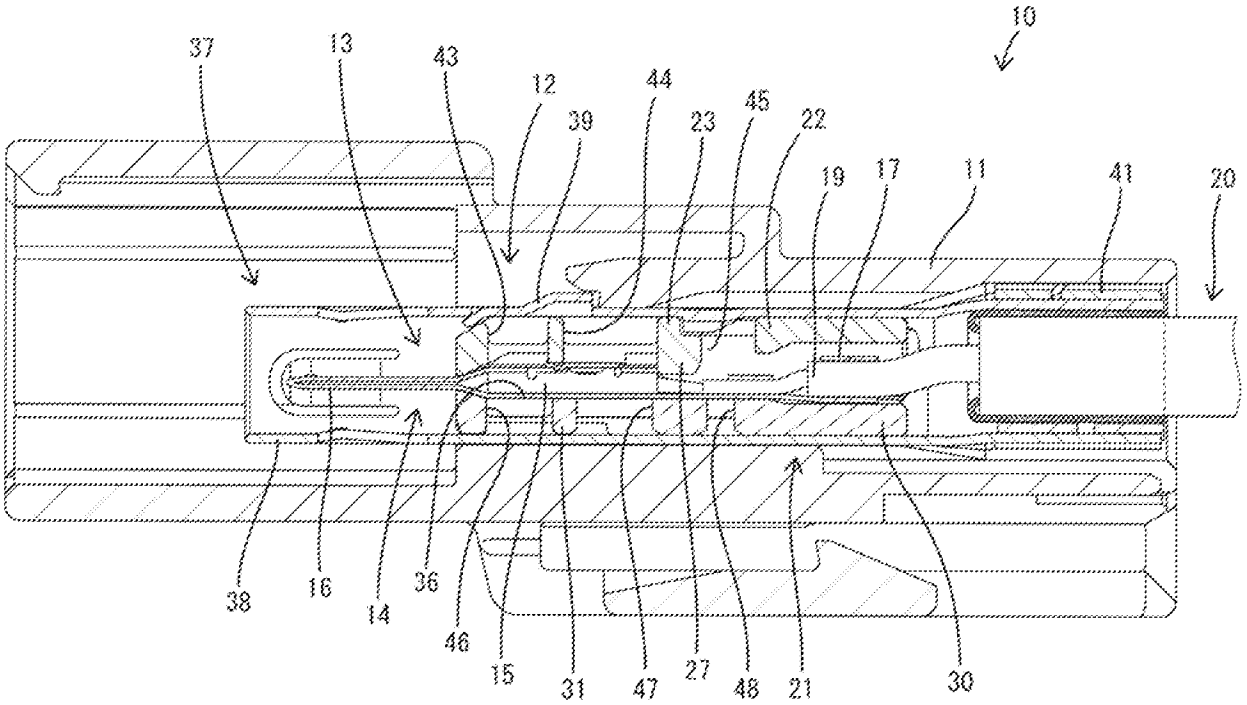
FIG. 1 is a section showing a state where a shield terminal of one embodiment is mounted in a housing.
Figure 2:
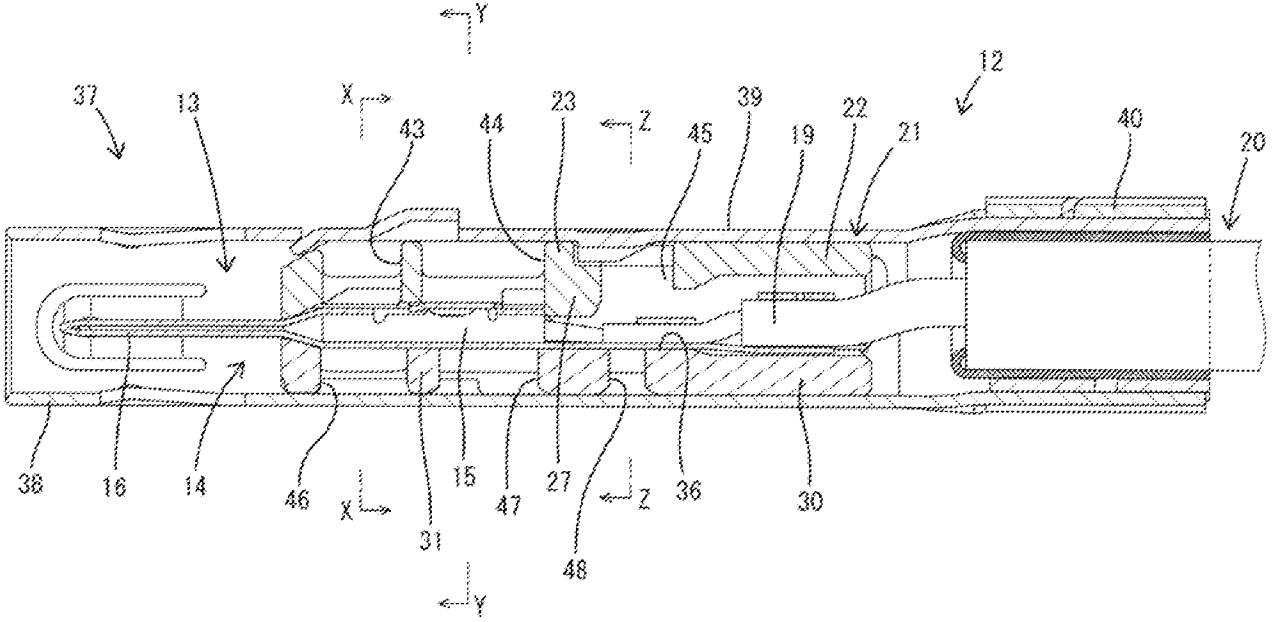
FIG. 2 is a section of the shield terminal.
Figure 3:
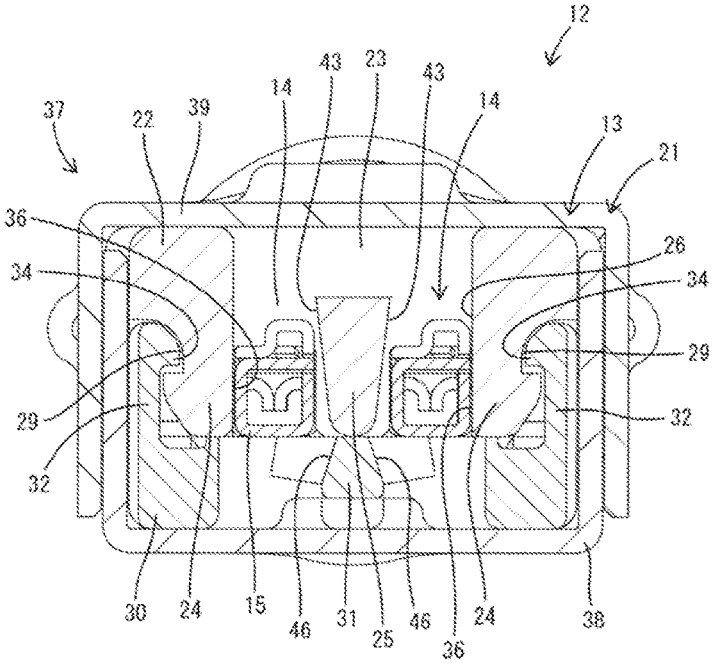
FIG. 3 is a section along X-X of FIG. 2.
Figure 4:
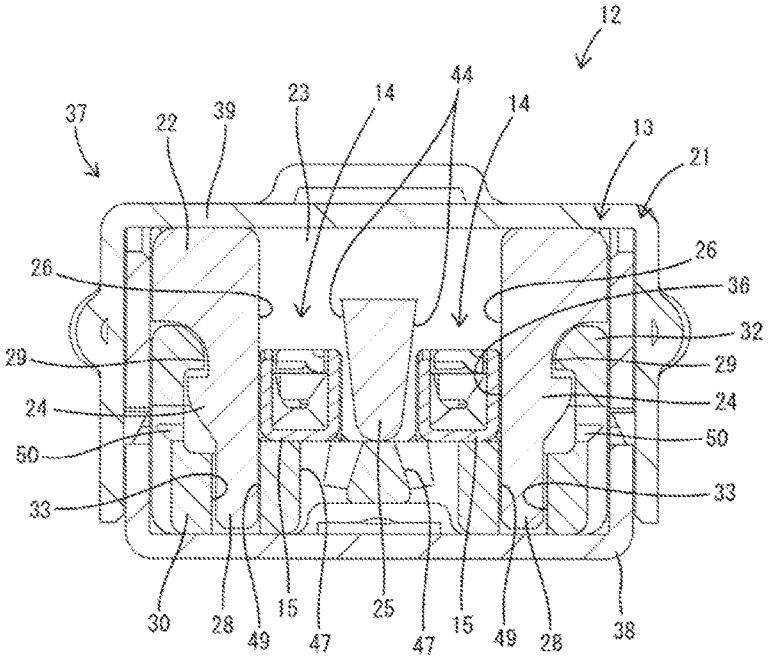
FIG. 4 is a section along Y-Y of FIG. 2.
Figure 5:
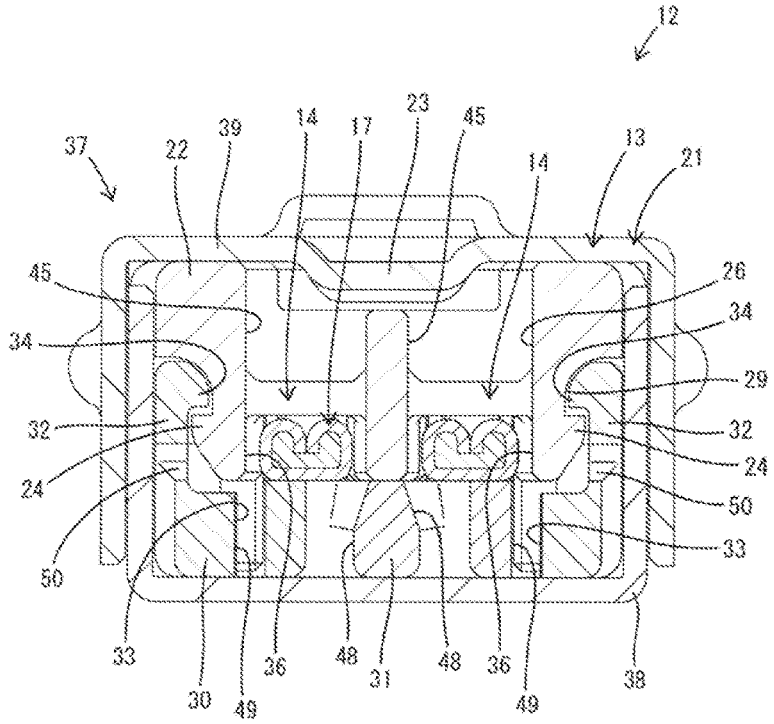
FIG. 5 is a section along Z-Z of FIG. 2.
Figure 6:
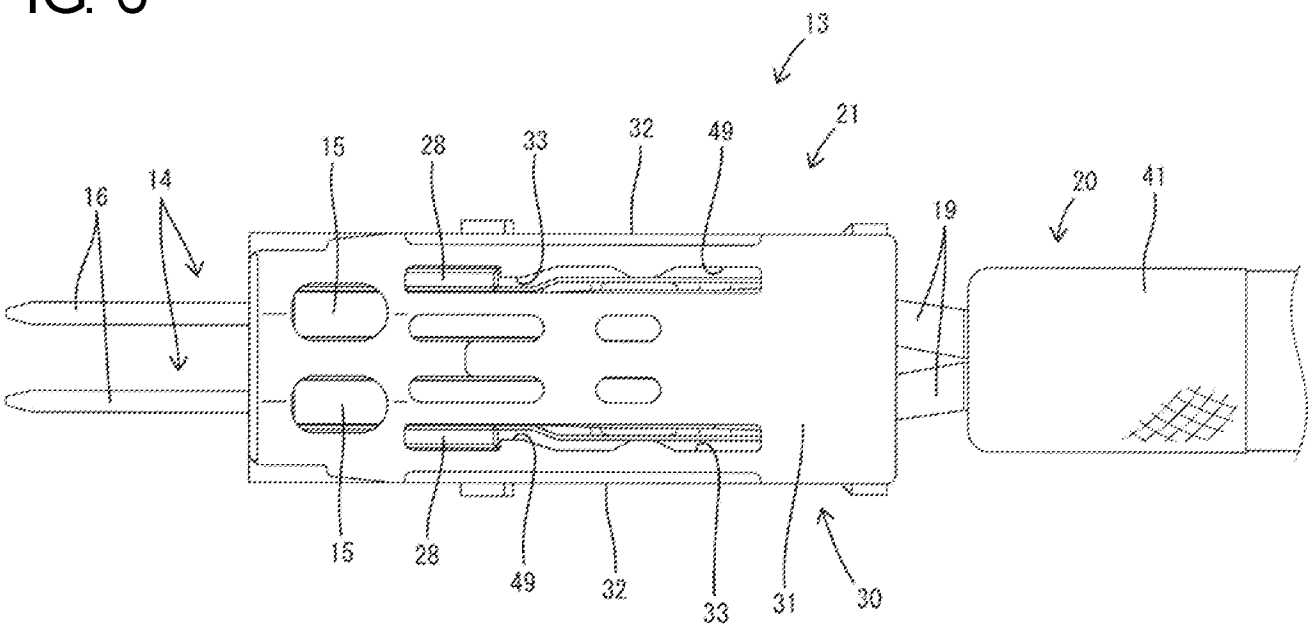
FIG. 6 is a plan view of the shield terminal.
Figure 7:
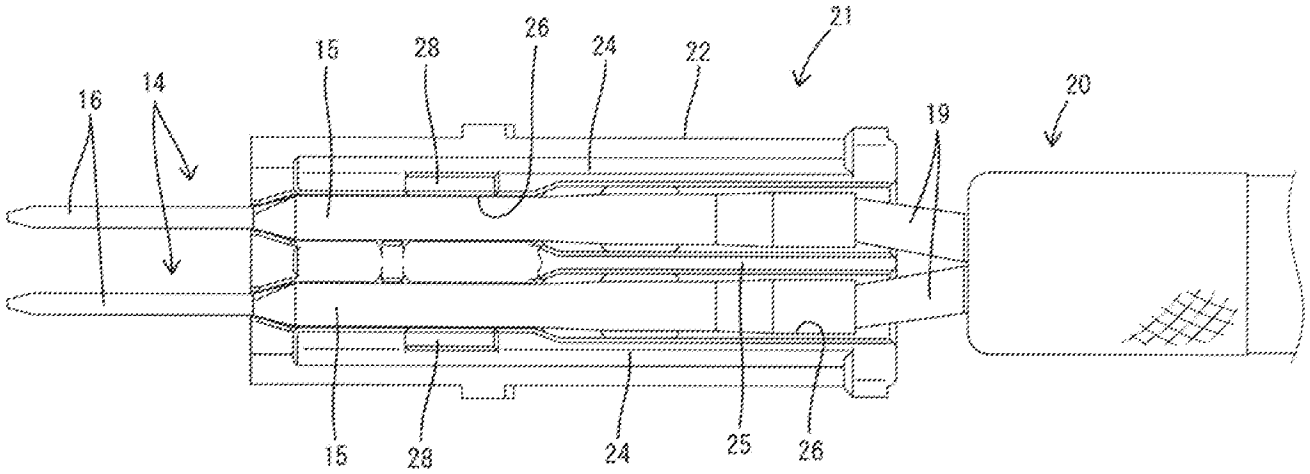
FIG. 7 is a plan view showing a state where inner conductors are mounted in a first component.
Figure 8:
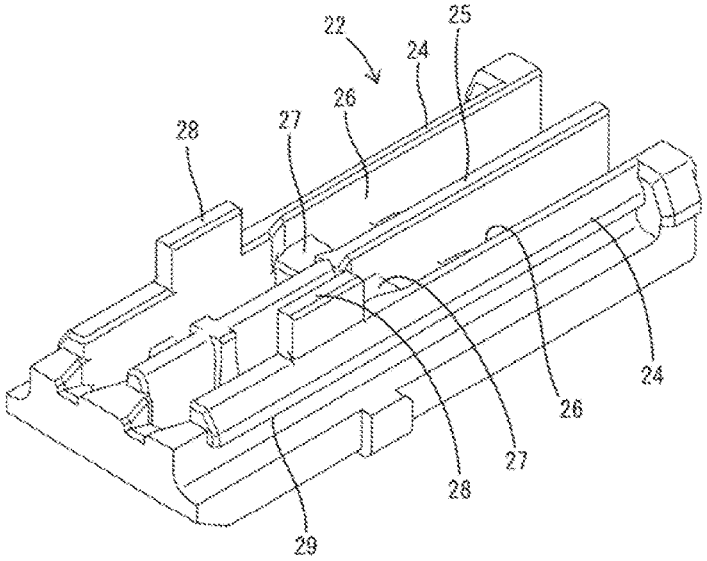
FIG. 8 is a perspective view of the first component.
Figure 9:
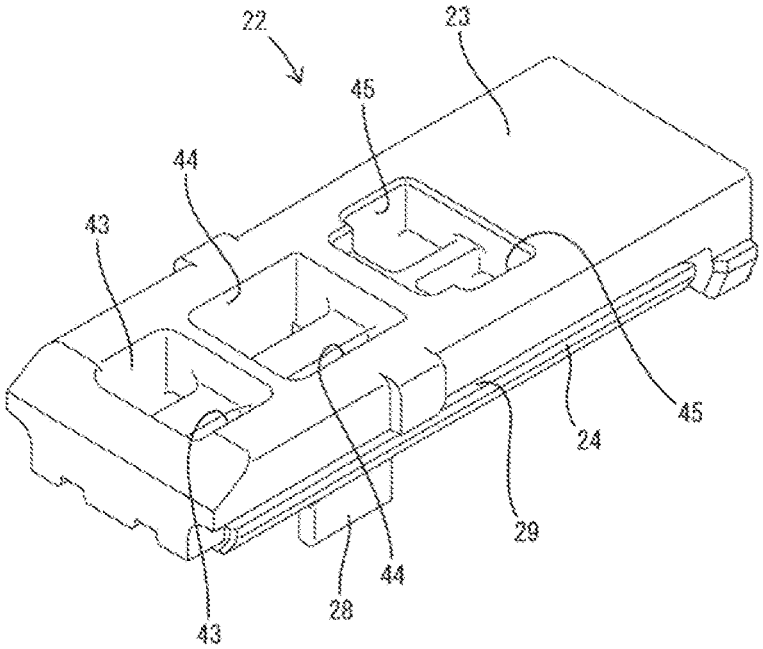
FIG. 9 is a perspective view showing a vertically inverted state of the first component.
Figure 10:
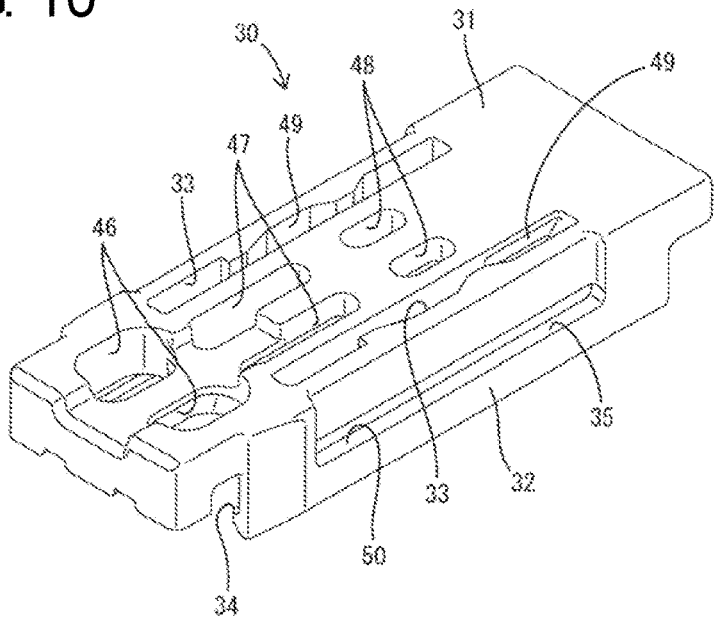
FIG. 10 is a perspective view of a second component.
Figure 11:
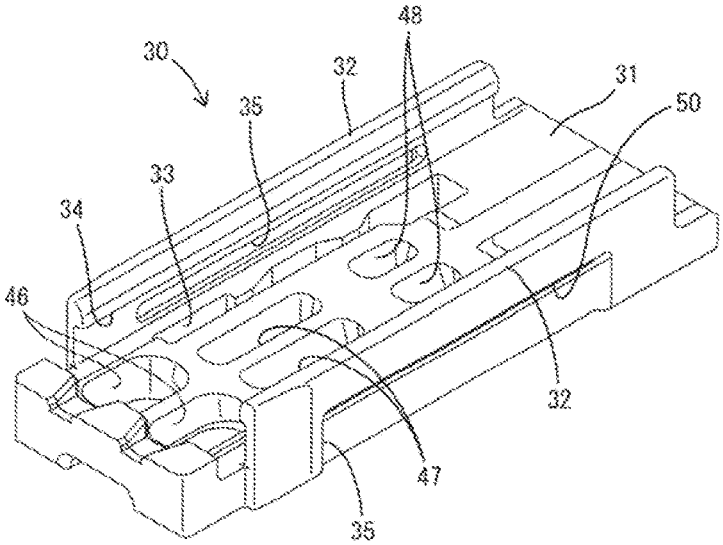
FIG. 11 is a perspective view showing a vertically inverted state of the second component.
Figure 12:
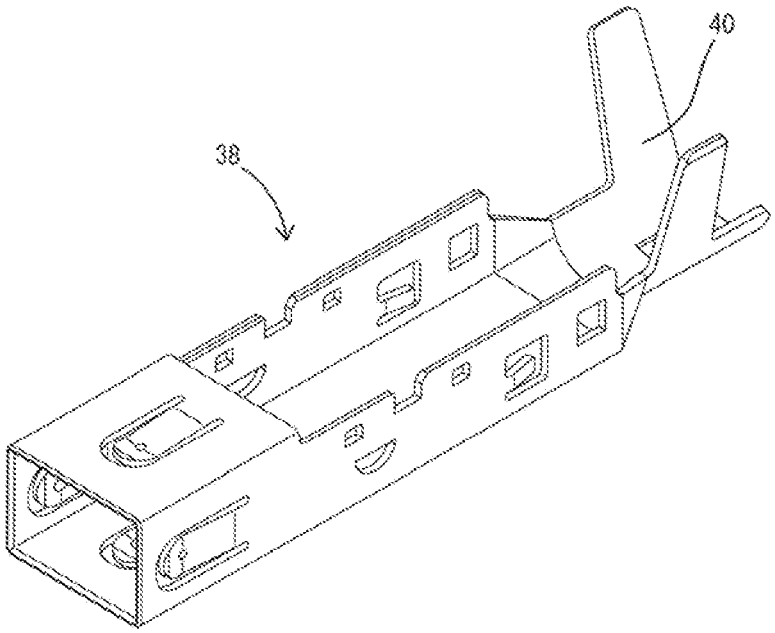
FIG. 12 is a perspective view of a first shell constituting an outer conductor.
Figure 13:
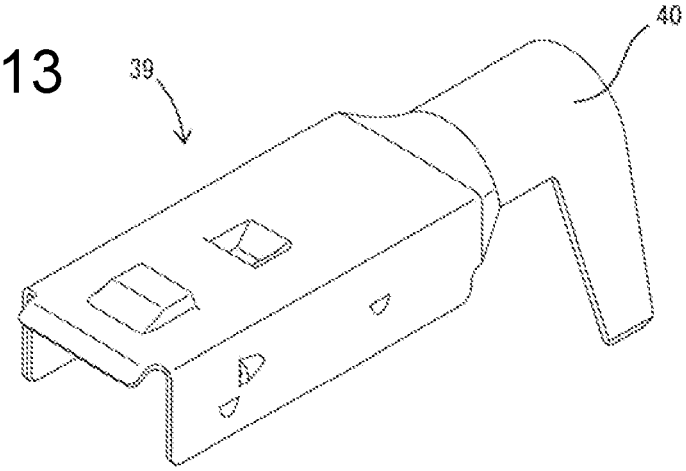
FIG. 13 is a perspective view showing of a second shell constituting the outer conductor.

Hereinafter, one specific embodiment of the present invention is described with reference to FIGS. 1 to 13. Note that, in the following description, a left side in FIGS. 1, 2, 6, 7, 8 and 10 is defined as a front side concerning a front-rear direction. Upper and lower sides shown in FIGS. 8 and 10 are directly defined as upper and lower sides and vertically inverted ones of upper and lower sides in FIGS. 1 to 5 are defined as upper and lower sides concerning a vertical direction.

A shield connector 10 of this embodiment is a connecting member constituting a wiring harness for Ethernet® high-speed communication circuit of an automotive vehicle and includes a housing 11 made of synthetic resin and a shield terminal 12 accommodated in the housing 11. The shield terminal 12 is configured by assembling a terminal unit 13 and an outer conductor 37. One terminal unit 13 is configured by mounting a pair of inner conductors 14 into a dielectric 21.

The inner conductor 14 is long and narrow in the front-rear direction as a whole. The inner conductor 14 includes a body 15 in the form of a rectangular tube, a long and narrow tab 16 projecting forward from the body 15 and a crimping portion 17 in the form of an open barrel connected to the rear end of the body 15. A step-like locking portion 18 is formed on a rear end part of the body 15. A front end part of a wire 19 is fixed electrically conductively to the crimping portion 17. Two wires 19 connected to two inner conductors 14 constitute a twisted pair cable 20.

The dielectric 21 is configured by uniting a first component 22 in the form of a halved piece and made of synthetic resin and a second component 30 in the form of a halved piece and made of synthetic resin in the vertical direction (direction intersecting axes of the front end parts of the wires 19). A material of the first component 22 is e.g. polypropylene (PP) having a lower dielectric constant than the second component 30 and a material of the second component 30 is e.g. polybutylene terephthalate (PBT) having higher mechanical strength than the first component 23.

The first component 22 includes a bottom wall 23 long and narrow in the front-rear direction, left and right side walls 24 rising from both left and right sides of the bottom wall 23 and a separation wall 25 rising from a lateral center of the bottom wall 23. Areas defined by the bottom wall 23, the side walls 24 and the separation wall 25 serve as grooves 26 long and narrow in the front-rear direction. Left and right projection-like retaining portions 27 facing the left and right grooves 26 are formed on the bottom wall 23. Sliding projections 28 are formed at positions near the front ends of upper end edges of the left and right side walls 24. Locking grooves 29 extending in the front-rear direction are formed in outer side surfaces of the left and right side wall portions 24.

The second component 30 includes an upper wall 31 long and narrow in the front-rear direction and left and right side plates 36 extending down from both left and right side edges of the upper wall 31. Two guide grooves 33 long and narrow in the front-rear direction are formed in left and right sides of the upper wall 31. The guide grooves 33 penetrate from the outer surface to the inner surface of the upper wall 31.

The two side plates 32 are formed with locking ribs 34 projecting in the front-rear direction from extending end edges of the inner surfaces thereof. Further, the left and right side plates 32 are formed with cuts 35 by cutting off areas of the side plates 32 excluding both front and rear end edges and the extending end edges. The cuts 35 penetrate from the outer surfaces to the inner surfaces of the side plates 32.

In assembling the first and second components 22, 30, the bodies 15 and the crimping portions 17 of the inner conductors 14 are placed individually into the two grooves 26 of the first component 22. Since the first and second components 22, 30 are divided in a direction substantially perpendicular to the front end parts of the wires 19 and united, a moving direction when the inner conductors 14 are placed is also a direction substantially perpendicular to the axes of the front end parts of the wires 19. This enables the wires 19 to be untwisted over a minimum possible length in the front end parts of the two wires 19 constituting the twisted pair cable 20. Thus, a reduction of a noise reducing function caused by untwisting the wires 19 advantageously is avoided.

The two inner conductors 14 placed in the first component 22 have displacements in the front-rear direction with respect to the first component 22 restricted by individually locking the locking portions 18 of the bodies 15 to the retaining portions 27. After the two inner conductors 14 are mounted into the first component 22, the second component 30 is assembled with the first component 22 from above to be united with the first component 22. An assembling direction of the second component 30 with the first component 22 is a direction substantially perpendicular to the axes of the front end parts of the wires 19.

When the first component 22 and the second component 30 are united, the dielectric 21 is configured and the united first and second components 22, 30 are held united by locking between the locking grooves 29 and the locking ribs 34. When united, left and right conductor accommodation chambers 36 for accommodating the bodies 15 and the crimping portions 17 of the inner conductors 14 are configured in the dielectric 21. Thus, the assembling of the terminal unit 13 is completed.

The second component 30 is slidable in the front-rear direction between a protecting position (not shown) for covering and protecting the tabs 16 by causing the guide grooves 33 and guide ribs to slide with each other and an exposing position (see FIGS. 1, 2 and 6) for exposing the tabs 16. Further, the second component 30 is held at the protecting position by locking the sliding projections 28 to rear end parts of the guide grooves 33 in a semi-locking state. Further, the second component 30 is held at the exposing position by locking the sliding projections 28 to front end parts of the guide grooves 33 in a semi-locking state.

The terminal unit 13 is surrounded by the rectangular tubular outer conductor 37 made of a metal material. The outer conductor 37 is configured by vertically uniting an upper shell 38 (see FIG. 12) and a lower shell (see FIG. 13). The shield terminal 12 is configured by surrounding the terminal unit 13 by the outer conductor 37. A barrel 40 formed in a rear end part of the outer conductor 37 is electrically conductively fixed to a braided wire 41 of the twisted pair cable 20. The shield terminal 12 fixed to the twisted pair cable 20 is assembled by being inserted into the housing 11 from behind.

Since the shield connector 10 and the shield terminal 12 of this embodiment are used for a high-speed communication circuit, impedance matching is preferable to enhance the reliability of communication performance. If an impedance is low, the first component 22 of the dielectric 21 is made of a material (such as polypropylene) having a low dielectric constant as a means for enhancing the impedance. However, since e.g. polypropylene has low mechanical rigidity, it cannot be said to be desirable as a material having a function of stably holding the inner conductors 14.

Accordingly, the second component 30 is made of a material (such as polybutylene terephthalate) having high mechanical strength (e.g. a higher mechanical strength than the first component 22) to enhance the reliability of the function of holding the inner conductors 14. However, polybutylene terephthalate has a high dielectric constant and causes an impedance reduction. Thus, as a means for enhancing the impedance without reducing the rigidity of the dielectric 21, air chambers 43 to 48 are formed in the bottom or base wall 23 and/or the upper or ceiling wall 31 forming at least part of the conductor accommodation chambers 36 of the dielectric 21.

Specifically, left and right front first air chambers 43 are formed in a front end part of the bottom wall 23, left and right central first air chambers 44 are formed at positions behind and near the front first air chambers 43 in the bottom wall 23 and left and right rear first air chambers 45 are formed at positions behind and near the central first air chambers 44 in the bottom wall 23. All of these first air chambers 43, 44 and 45 communicate with the insides of the conductor accommodation chambers 36 and the outside of the dielectric 21. In other words, the first air chambers 43, 44, 45 laterally extend from the conductor accommodation chambers 36 to an outer side of the dielectric 21.

An area of the bottom wall 23 between the front first air chambers 43 and the rear first air chambers 45 functions as a reinforcing portion. The left and right front first air chambers 43 communicate with each other in the outer surface of the bottom wall 23 to constitute one space. The left and right central first air chambers 44 communicate with each other in the outer surface of the bottom wall 23 to constitute one space. The left and right rear first air chambers 45 communicate with each other in the outer surface of the bottom wall 23 to constitute one space.

Further, front second air chambers 46 are formed in a front end part of the upper wall 31 of the second component 30, left and right central second air chambers 47 are formed at positions behind and near the front second air chambers 46 in the bottom wall 23 and left and right rear second air chambers 48 are formed at positions behind and near the central second air chambers 47 in the bottom wall 23. All of these second air chambers 46, 47 and 48 communicate with the insides of the conductor accommodation chambers 36 and the outside of the dielectric 21. In other words, the second air chambers 46, 47, 48 laterally extend from the conductor accommodation chambers 36 to an outer side of the dielectric 21.

A formation area of the front second air chambers 46 in the front-rear direction is substantially the same as that of the front first air chambers 43. A formation area of the central second air chambers 47 in the front-rear direction is substantially the same as that of the central first air chambers 44. A formation area of the rear second air chambers 48 in the front-rear direction is substantially the same as that of the rear first air chambers 45. An area of the upper wall 31 between the front second air chambers 46 and the rear second air chambers 48 is a reinforcing portion. Further, the left and right guide grooves 33 formed in the upper wall 31 function as lateral air chambers 49. Two cuts 35 formed in the left and right side plates 32 function as side surface air chambers 50.

The shield terminal 12 of this embodiment includes the two inner conductors 14 having the tabs 16 projecting forward from the bodies 15, the dielectric 21 formed with the conductor accommodation chambers 36 inside and configured to hold the inner conductors 14 with the bodies 15 accommodated in the conductor accommodation chambers 36, the outer conductor 37 for surrounding the dielectric 21 and the tabs 16, and/or the base wall 23, the upper wall 31 and/or the side plates 32 forming part of the conductor accommodation chambers 36, the bottom wall 23 being formed with the air chambers 43 to 45, the upper wall 31 being formed with the air chambers 46 to 49, the side plate portions 32 being formed with the air chambers 50.

Polybutylene terephthalate, which is the material of the second component 30 constituting the dielectric 21 of this embodiment, has relatively high mechanical strength but, on the other hand, has a low dielectric constant. Thus, an impedance may be reduced. Accordingly, focusing on the fact that air has a lower dielectric constant than synthetic resin as the material of the dielectric 21 (first component 22 and second component 30), the air chambers 43 to 50 are formed in the bottom wall 23, the upper wall 31 and the side plates 32 forming part of the conductor accommodation chambers 36 of the dielectric 21. Since the air chambers 43 to 50 having a low dielectric constant are formed, it is realized to enhance the impedance and enhance the reliability of communication quality even if a material having high rigidity is used for the dielectric 21.

Further, the dielectric 21 is configured by uniting the first component 22 formed with the grooves 26 constituting the conductor accommodation chambers 36 and the second component 30 for holding the inner conductors 14 mounted in the grooves 26 to sandwich the inner conductors 14 between the first component 22 and the second component 30. The first and second components 22, 30 are kept united by locking the locking grooves 29 formed in the outer side surfaces of the first component 22 and the locking ribs 34 formed on the inner side surfaces of the second component 30. The air chambers 43 to 48 are formed in the bottom wall 23 of the first component 22 and the upper wall 31 of the second component 30. Since the bottom wall 23 and the upper wall 31 are areas not formed with the locking grooves 29 and the locking ribs 34, a degree of freedom in design is high in setting the formation positions of the air chambers 43 to 48.

Further, the dielectric 21 is configured by uniting the first component 22 formed with the grooves 26 constituting the conductor accommodation chambers 36 by erecting the separation wall 25 from the bottom wall 23 and the second component 30 including the upper wall 31 for covering the grooves 26. The material of the first component 22 is polypropylene having a lower dielectric constant than the second component 30 and the material of the second component 30 is polybutylene terephthalate having higher mechanical strength than the first component 22. According to this configuration, the first component 22 is made of the material having lower mechanical strength than the second component 30, but the strength thereof is increased as a whole since having a larger volume by possessing the separation wall 25. Further, since the first component 22 having a large volume has a low dielectric constant, an impedance can be enhanced.

The second component 30 is formed with the side plates 32 that are locked to the outer surfaces of the side walls 24 of the first component 22, and the side plates 32 are formed with the side surface air chambers 50 (cut portions 35). Since the second component 30 is made of the material having higher mechanical strength than the first component 22, the strength of the side plates 32 is maintained even if the side surface air chambers 50 are formed.

Further, the inner conductors 14 include the tabs 16 projecting forward from the dielectric 21, and the dielectric 21 is configured by uniting the first component 22 formed with the grooves 26 constituting the conductor accommodation chambers 36 by erecting the separation wall 25 from the bottom wall 23 and the second component 30 for holding the inner conductors 14 mounted in the grooves 26 to sandwich the inner conductors 14 between the first component 22 and the second component 30.

The first component 22 is formed with the sliding projections 28, the second component 30 is formed with the guide grooves 33 functioning as the lateral air chambers 49, and the second component 30 is slidable between the protecting position for covering the tabs 16 and the exposing position for exposing the tabs 16 by causing the sliding projections 28 to slide in contact with the guide grooves 33. According to this configuration, the guide grooves 33 double as the lateral air chambers 49 to exhibit a function of enhancing the impedance. Further, the guide grooves 33 need not be formed in the first component 22 having relatively low strength.

The invention is not limited to the above described and illustrated embodiment. For example, the following embodiments are also included in the technical scope of the present invention.

Although the air chambers of the first component are formed only in the bottom wall portion in the above embodiment, the air chambers may be formed in the side surfaces of the first component.

Although the air chambers of the second component are formed only in the upper wall and the side surfaces in the above embodiment, the air chambers of the second component may be formed only in the upper wall.

Although the air chambers are formed in the bottom wall, the upper wall and the side plates of the dielectric in the above embodiment, the air chambers may be formed in any one or two of the bottom wall, the upper wall and the side plates.

Although the retaining portions are formed on the rear ends of the air chambers in the above embodiment, the retaining portions may be disposed at positions behind the rear ends of the air chambers.

Although the air chambers penetrate from the inner surface to the outer surface of the dielectric in the above embodiment, the air chambers may be formed by recessing the inner or outer surface of the dielectric without penetrating from the inner surface to the outer surface of the dielectric.

Although two inner conductors are accommodated in one dielectric in the above embodiment, one, three or more inner conductors may be accommodated into one dielectric.

Although the dielectric is composed of two components, i.e. the first component and the second component in the above embodiment, the dielectric may be composed of a single component.

Although two wires connected to the pair of inner conductors constitute the twisted pair cable in the above embodiment, the present invention can be applied also when a wire to be connected to an inner conductor does not constitute a twisted pair cable.

Although the material of the second component is polybutylene terephthalate (PBT) in the above embodiment, the material of the second component may be other than polybutylene terephthalate.

Although the material of the first component is polypropylene (PP) in the above embodiment, the material of the first component may be polyethylene (PE), polystyrene (PS), foamed polybutylene terephthalate or the like.

Although a combination of the materials of the first component and the second component is a combination of polypropylene and polybutylene terephthalate in the above embodiment, the combination of the materials of the first component and the second component may be a combination of polyethylene (PE) and polybutylene terephthalate or a combination of foamed polybutylene terephthalate and polybutylene terephthalate.

REFERENCE SIGNS

. . . 12 shield terminal
. . . 14 inner conductor
. . . 15 body
. . . 16 tab
. . . 21 dielectric
. . . 22 first component
. . . 23 bottom wall
. . . 24 side wall portion
. . . 25 separation wall
. . . 26 groove
. . . 29 locking groove
. . . 30 second component
. . . 31 upper wall
. . . 32 side plate
. . . 34 locking rib
. . . 36 conductor accommodation chamber
. . . 37 outer conductor
. . . 43 front first air chamber
. . . 44 central first air chamber
. . . 45 rear first air chamber
. . . 46 front second air chamber
. . . 47 central second air chamber
. . . 48 rear second air chamber
. . . 49 lateral air chamber
. . . 50 side surface air chamber

What is claimed is:

1. A shield terminal, comprising:

at least one inner conductor having a body and a tab projecting substantially forward from the body;

a dielectric configured by uniting first and second components, the first component being formed with at least one conductor accommodation chamber (36) inside, the second component including a ceiling wall at least partly covering the conductor accommodating chamber and configured to hold the inner conductor with the body at least partly accommodated in the conductor accommodation chamber, at least one wall of the dielectric that defines part of the conductor accommodating chamber being formed with at least one air chamber; and at least one outer conductor for at least partly surrounding the dielectric and the tab;

wherein:

the first component is made of a material having a lower dielectric constant than the second component; and the second component is made of a material having higher mechanical strength than the first component.

2. The shield terminal of claim 1, wherein the first component is formed with at least one groove forming at least part of the conductor accommodation chamber and the second component is configured for holding the at least one inner conductor mounted in the at least one groove to position the inner conductor between the first component and the second component.

3. The shield terminal of claim 2, wherein the first and second components of the dielectric are kept united by locking a side surface of the first component and a lock formed on a side surface of the second component.

4. The shield terminal of claim 2, wherein the air chamber is formed in at least one of a bottom wall of the first component and an upper wall of the second component.

5. The shield terminal of claim 2, wherein the first component is formed with a base wall defining a bottom of the at least one groove and at least one separation wall rising from a base wall and the second component including a ceiling wall opposed to the base wall and at least partly covering the groove.

6. The shield terminal of claim 2, wherein the second component is formed with at least one side plate locked to an outer surface of a side wall of the first component.

7. The shield terminal of claim 6, wherein the air chamber is formed in the side plate.

8. The shield terminal of claim 1, wherein the first component is made of a material having a lower mechanical strength than the second component.

9. The shield terminal of claim 8, wherein the second component is made of a material having a higher dielectric constant than the first component.

10. The shield terminal of claim 1, wherein the first component is made of polypropylene.

11. The shield terminal of claim 1, wherein the second component is made of polybutylene terephthalate.

* * * * *